US010883064B2

(12) United States Patent
Sunagawa

(10) Patent No.: US 10,883,064 B2
(45) Date of Patent: Jan. 5, 2021

(54) LUBRICANT OIL COMPOSITION AND LUBRICATION METHOD

(71) Applicant: IDEMITSU KOSAN CO.,LTD., Tokyo (JP)

(72) Inventor: Yoji Sunagawa, Sodegaura (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 0 days.

(21) Appl. No.: 16/086,500

(22) PCT Filed: Mar. 13, 2017

(86) PCT No.: PCT/JP2017/009962
§ 371 (c)(1),
(2) Date: Sep. 19, 2018

(87) PCT Pub. No.: WO2017/163977
PCT Pub. Date: Sep. 28, 2017

(65) Prior Publication Data

US 2019/0119597 A1 Apr. 25, 2019

(30) Foreign Application Priority Data

Mar. 23, 2016 (JP) ..... 2016-058538

(51) Int. Cl.

| | |
|---|---|
| ***C10M 161/00*** | (2006.01) |
| ***C10M 129/68*** | (2006.01) |
| ***C10M 129/95*** | (2006.01) |
| ***C10M 135/20*** | (2006.01) |
| ***C10M 137/04*** | (2006.01) |
| ***C10M 143/00*** | (2006.01) |

(Continued)

(52) U.S. Cl.

CPC ..... *C10M 161/00* (2013.01); *C10M 129/68* (2013.01); *C10M 129/95* (2013.01); *C10M 135/20* (2013.01); *C10M 137/04* (2013.01); *C10M 143/00* (2013.01); *C10M 2203/1025* (2013.01); *C10M 2205/02* (2013.01); *C10M 2205/022* (2013.01); *C10M 2205/0285* (2013.01); *C10M 2207/026* (2013.01); *C10M 2207/126* (2013.01); *C10M 2207/28* (2013.01); *C10M 2207/34* (2013.01); *C10M 2209/084* (2013.01); *C10M 2215/28* (2013.01); *C10M 2219/08* (2013.01); *C10M 2219/082* (2013.01); *C10M 2219/106* (2013.01); *C10M 2223/04* (2013.01); *C10N 2020/02* (2013.01); *C10N 2020/04* (2013.01); *C10N 2030/02* (2013.01); *C10N 2030/06* (2013.01); *C10N 2030/42* (2020.05); *C10N 2030/43* (2020.05); *C10N 2030/68* (2020.05); *C10N 2040/02* (2013.01); *C10N 2040/04* (2013.01); *C10N 2040/044* (2020.05); *C10N 2040/08* (2013.01); *C10N 2040/135* (2020.05); *C10N 2040/20* (2013.01); *C10N 2040/22* (2013.01); *C10N 2040/25* (2013.01); *C10N 2040/252* (2020.05); *C10N 2040/255* (2020.05); *C10N 2040/30* (2013.01)

(58) Field of Classification Search

CPC ..... C10M 161/00; C10M 137/04; C10M 143/00; C10M 135/20; C10M 2203/1025; C10M 2205/02; C10M 2205/0285; C10M 2207/026; C10M 2219/106; C10M 2219/082; C10M 2215/28; C10M 2209/084; C10M 2207/126; C10M 2223/04; C10M 2219/08; C10M 2205/022; C10N 2240/02; C10N 2240/401; C10N 2240/50; C10N 2240/30; C10N 2240/14; C10N 2240/104; C10N 2240/102; C10N 2240/10; C10N 2240/08; C10N 2240/044; C10N 2230/68; C10N 2230/43; C10N 2230/42; C10N 2230/02; C10N 2230/06; C10N 2220/022; C10N 2220/021; C10N 2240/04

See application file for complete search history.

(56) References Cited

U.S. PATENT DOCUMENTS 5,358,650 A * 10/1994 Srinivasan ..... C10M 133/56 508/194
5,883,057 A * 3/1999 Roell, Jr. ..... C10M 143/00 508/469

(Continued)

FOREIGN PATENT DOCUMENTS

EP 1 471 133 A2 10/2004
EP 2 412 790 A1 2/2012

(Continued)

OTHER PUBLICATIONS

International Search Report dated May 16, 2017, in PCT/JP2017/009962 filed Mar. 13, 2017.

(Continued)

*Primary Examiner* — Taiwo Oladapo
(74) *Attorney, Agent, or Firm* — Oblon, McClelland, Maier & Neustadt, L.L.P.

(57) ABSTRACT

Provided are; a lubricating oil composition excellent in fuel saving performance, seizure resistance, wear resistance, fatigue lifetime and shear stability, which contains a base oil (A), an olefin polymer (B) having a number average molecular weight of 1,000 or more and 12,000 or less, and a specific sulfur compound (C) and wherein the content of all sulfur atoms based on the total amount of the composition is 1.2% by mass or more and 2.5% by mass or less; and a lubrication method using the lubricating oil composition.

8 Claims, No Drawings

(51) Int. Cl.

| | |
|---|---|
| *C10N 20/02* | (2006.01) |
| *C10N 20/04* | (2006.01) |
| *C10N 30/02* | (2006.01) |
| *C10N 30/06* | (2006.01) |
| *C10N 30/00* | (2006.01) |
| *C10N 40/02* | (2006.01) |
| *C10N 40/04* | (2006.01) |
| *C10N 40/08* | (2006.01) |
| *C10N 40/20* | (2006.01) |
| *C10N 40/22* | (2006.01) |
| *C10N 40/25* | (2006.01) |
| *C10N 40/30* | (2006.01) |
| *C10N 40/00* | (2006.01) |

(56) References Cited

U.S. PATENT DOCUMENTS

| | | | |
|---|---|---|---|
| 2004/0147410 | A1 | 7/2004 | Milner et al. |
| 2008/0269085 | A1 | 10/2008 | Haire et al. |

FOREIGN PATENT DOCUMENTS

| | | | |
|---|---|---|---|
| EP | 2 832 832 | A1 | 2/2015 |
| JP | 8-508531 | A | 9/1996 |
| JP | 9-194865 | A | 7/1997 |
| JP | 2004-217797 | A | 8/2004 |
| JP | 2007-39480 | A | 2/2007 |
| JP | 2008-37963 | A | 2/2008 |
| JP | 2008-274276 | A | 11/2008 |
| JP | 2009-520085 | A | 5/2009 |
| JP | 2010-195894 | A | 9/2010 |
| JP | 2011-6635 | A | 1/2011 |
| JP | 2011-46903 | A | 3/2011 |
| JP | 2012-46683 | A | 3/2012 |

OTHER PUBLICATIONS

Office Action dated Jul. 9, 2019 in Japanese Patent Application No. 2016-058538 (with unedited computer generated English translation).

European Office Action dated Apr. 6, 2020 in Patent Application No. 17 770 020.0, 5 pages.

Extended European Search Report dated Jul. 24, 2019 in Patent Application No. 17770020.0, citing documents AO-AQ therein, 7 pages.

Japanese Office Action dated Oct. 8, 2019 in Patent Application No. 2016-058538 (with English translation), 3 pages.

International Search Report issued May 16, 2017, in PCT/JP2017/009962 filed Mar. 13, 2017.

* cited by examiner

LUBRICANT OIL COMPOSITION AND LUBRICATION METHOD

TECHNICAL FIELD

The present invention relates to a lubricating oil composition, and a lubrication method using the same.

BACKGROUND ART

A lubricating oil composition is used in various fields, and, for example, used for internal combustion engines for gasoline engines, diesel engines and other internal combustion engines, or for gearings. A lubricating oil composition is desired to satisfy specific requirements responding to the use thereof. For example, a lubricating oil composition for gearings is used for preventing damage and seizure of gears in use for automobile or other high-speed high-load gears, relatively light-load gears for general machinery, relatively high-load gears for general machinery, etc. For preventing damage and seizure of gears, properties of seizure resistance and wear resistance and also shear stability are required, and, for example, for manual transmissions, friction characteristics of synchronizer mechanism are needed, and for differential gears, seizure resistance is especially required.

In addition to specific properties depending on use, improvement of fuel saving performance is also required as a general performance. As a method of improving fuel saving performance, for example, use of a low-viscosity lubricating oil to reduce dragging resistance by viscosity may be taken into consideration.

As a lubricating oil to attain fuel saving performance by viscosity reduction, for example, a lubricating oil composition containing a lubricant base oil having a predetermined 100° C. kinematic viscosity, and an ethylene-α-olefin copolymer (see PTL 1), a lubricant composition containing an oil having a lubricative viscosity, a dispersant, and a phosphorus-based extreme-pressure agent (see PTL 2), and a lubricating oil composition obtained by adding an additive such as an extreme-pressure agent to a predetermined synthetic oil of a base oil (see PTL 3) have been proposed.

CITATION LIST

Patent Literature

PTL 1: JP 2008-037963 A
PTL 2: JP 2009-520085 A
PTL 3: JP 2007-039480 A

SUMMARY OF INVENTION

Technical Problem

However, oil film shortage may often occur in a sliding portion in a mere method of improving fuel saving performance by viscosity reduction, therefore often causing damage and seizure of gears to provide another problem of shortening a fatigue lifetime. In addition, by oil film shortage, contact frequency between teeth of a gear may increase to cause energy loss by friction, therefore resulting in fuel saving performance degradation. Thus, fuel saving performance, and seizure resistance and wear resistance are contradictory properties, and it is difficult to enhance both the two properties at the same time.

Regarding the lubricating oil composition described in PTL 1, the viscosity thereof can be reduced, but the composition could not till satisfy more severer requirements in point of seizure resistance. The lubricating oil composition described in PTL 2 uses an extreme-pressure agent, and therefore can have seizure resistance on some level; however, the composition could not still satisfy severer requirements. The lubricating oil composition described in PTL 3 also uses an extreme-pressure agent, and therefore has seizure resistance on some level in addition to fuel saving performance; however, the composition could not also satisfy severer requirements.

The present invention has been made in consideration of the above-mentioned situations, and its object is to provide a lubricating oil composition excellent in fuel saving performance, seizure resistance, wear resistance, fatigue lifetime and shear stability, and to provide a lubrication method using the lubricating oil composition.

Solution to Problem

As a result of earnest studies, the present inventors have found that the above-mentioned problems can be solved the following invention. Specifically, the present invention provides a lubricating oil composition having a constitution mentioned below, and a lubrication method using it.

1. A lubricating oil composition containing a base oil (A), an olefin polymer (B) having a number average molecular weight of 1,000 or more and 12,000 or less, and a sulfur compound (C) having a structural unit shown by the following general formula (1), the content of all sulfur atoms based on the total amount of the composition being 1.2% by mass or more and 2.5% by mass or less.

$$\text{-}(R^1\text{—}S_{m1})\text{-} \quad (1)$$

wherein $R^1$ represents a divalent hydrocarbon group, and $m_1$ represents an integer of 4 or more.

2. A lubrication method using the lubricating oil composition according to the above 1.

Advantageous Effects of Invention

According to the present invention, there can be provided a lubricating oil composition excellent in fuel saving performance, seizure resistance, wear resistance, fatigue lifetime and shear stability, and a lubrication method using the lubricating oil composition.

DESCRIPTION OF EMBODIMENTS

Embodiments of the present invention (hereinafter may be referred to as "the present embodiments") are described below. In this description, the numerical values of "or more" and "or less" relating to the description of a numerical value range are values that can be combined in any desired manner.

[Lubricating Oil Composition]

The lubricating oil composition of present embodiment contains a base oil (A), an olefin polymer (B) having a number average molecular weight of 1,000 or more and 12,000 or less, and a sulfur compound (C) having a structural unit shown by the above-mentioned general formula (1), and the content of all sulfur atoms based on the total amount of the composition is 1.2% by mass or more and 2.5% by mass or less.

<Base Oil (A)>

The lubricating oil composition of the present embodiment contains a base oil (A). The base oil (A) may be a mineral oil or may be a synthetic oil.

The mineral oil includes topped crudes obtained through atmospheric distillation of crude oils such as paraffin base crude oils, naphthene base crude oils and intermediate base crude oils; distillates obtained through reduced-pressure distillation of such topped crudes; mineral oils obtained by purifying the distillates through one or more purification treatments of solvent deasphalting, solvent extraction, hydrocracking, solvent dewaxing, catalytic dewaxing or hydrorefining, for example, a light neutral oil, an intermediate neutral oil, a heavy neutral oil, and a bright stock; and mineral oils obtained through isomerization of wax produced through Fischer-Tropsch synthesis (GTL wax).

In addition, the mineral oil may also be those grouped in Groups 1, 2 and 3 in the base oil category by API (American Petroleum Institute), and those grouped in Groups 2 and 3 are preferred from the viewpoint of preventing sludge formation and attaining viscosity characteristics and stability against oxidation degradation.

Examples of the synthetic oil include poly-α-olefins such as polybutene, ethylene-α-olefin copolymers, α-olefin homopolymers or copolymers; various esters such as polyol esters, dibasic acid esters and phosphate esters; various ethers such as polyphenyl ethers; polyglycols; alkylbenzenes; and alkylnaphthalenes.

Among the above-mentioned synthetic oils, especially from the viewpoint of shear stability, poly-α-olefins and ester oils are preferred; and poly-α-olefins (PAO), polyol esters, dibasic acid esters and carbonates are more preferred.

For the base oil (A), one of the above-mentioned mineral oils may be used singly or plural kinds thereof may be used in combination, or the above-mentioned synthetic oils may be used singly, or plural kinds thereof may be used in combination. In addition, one or more kinds of mineral oils may be combined with one or more kinds of synthetic oils to give a mixed oil for use herein.

In the case where a mineral oil and a synthetic oil are combined to be a mixed oil, the content of the synthetic oil relative to the base oil is preferably 1% by mass or more, more preferably 2% by mass or more, even more preferably 3% by mass or more. The upper limit is preferably 30% by mass or less, more preferably 25% by mass or less, even more preferably 20% by mass or less. The mixed oil has an advantage of improving viscosity index.

The viscosity of the base oil (A) is not specifically limited, but the kinematic viscosity at 100° C. thereof is preferably 1 $mm^2/s$ or more, more preferably 2 $mm^2/s$ or more, even more preferably 3 $mm^2/s$ or more. The upper limit is preferably 12 $mm^2/s$ or less, more preferably 11 $mm^2/s$ or less, even more preferably 10 $mm^2/s$ or less. The kinematic viscosity at 40° C. of the base oil (A) is preferably 7 $mm^2/s$ or more, more preferably 8 $mm^2/s$ or more, even more preferably 10 $mm^2/s$ or more. The upper limit is preferably 35 $mm^2/s$ or less, more preferably 34 $mm^2/s$ or less, even more preferably 33 $mm^2/s$ or less. The kinematic viscosity of the base oil (A) falling within the above range betters fuel saving performance, and also betters seizure resistance, wear resistance, fatigue lifetime and shear stability.

In addition from the viewpoint of bettering fuel saving performance, seizure resistance, wear resistance and fatigue lifetime, the viscosity index of the base oil (A) is preferably 90 or more, more preferably 100 or more, even more preferably 110 or more. In this description, the kinematic viscosity and the viscosity index are values measured using a glass capillary viscometer according to JIS K 2283:2000.

The content of the base oil (A) based on the total amount of the composition is generally 50% by mass or more, preferably 60% by mass or more, more preferably 70% by mass or more, even more preferably 80% by mass or more. The upper limit is preferably 97% by mass or less, more preferably 95% by mass or less, even more preferably 93% by mass or less.

<Olefin Polymer (B)>

The lubricating oil composition of the present embodiment contains an olefin polymer (B) having a number average molecular weight of 1,000 or more and 12,000 or less (hereinafter may be simply referred to as "olefin polymer (B)"). The olefin polymer (B) has an effect of improving viscosity index, and, in particular, blending with this can improve fuel saving performance, fatigue lifetime and shear stability.

As the olefin polymer (B), a homopolymer or a copolymer of an a olefin, an ethylene-α-olefin copolymer, a polybutene and the like are preferred; an α-olefin copolymer and an ethylene-α-olefin copolymer are more preferred; and an ethylene-α-olefin copolymer is even more preferred.

The homopolymer or copolymer of an α-olefin is preferably a homopolymer or a copolymer of an α-olefin having 4 or more and 20 or less carbon atoms, more preferably 6 or more and 16 or less carbon atoms, even more preferably 6 or more and 14 or less carbon atoms, and further more preferably 8 or more and 12 or less carbon atoms, and is especially preferably an α-olefin copolymer (OCP). The α-olefin copolymer may be a random form or a block form.

Examples of the α-olefin usable for the homopolymer of copolymer of an α-olefin include α-olefins having 4 to 20 carbon atoms such as isobutylene, 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene and 1-eicosene.

The ethylene-α-olefin copolymer is a copolymer of ethylene and an α-olefin, and as the α-olefin, propylene and the same as those used for the above-mentioned α-olefin homopolymer and copolymer may be used. The ethylene-α-olefin copolymer may be a random form or a block form.

One of these olefin polymers may be used singly or plural kinds thereof may be used in combination.

These olefin polymers are non-dispersant types relative to lubricating oil, but dispersant-type ones grafted with, for example, maleic acid, N-vinylpyrrolidone, N-vinylimidazole or glycidyl acrylate are also usable.

These olefin polymers may be produced in any method. For example, these may be produced through catalyst-free thermal reaction, and in addition thereto, these may also be produced through olefin homopolymerization or copolymerization using a known catalyst system, such as an organic peroxide catalyst such as benzoyl peroxide; a Friedel-Crafts catalyst such as aluminum chloride, an aluminum chloride-polyalcohol system, an aluminum chloride-titanium tetrachloride system, an aluminum chloride-alkyltin halide system, or boron fluoride; a Ziegler catalyst such as an organic aluminum chloride-titanium tetrachloride system, or an organic aluminum-titanium tetrachloride system; a metallocene catalyst such as an aluminoxane-zirconocene, or an ionic compound-zirconocene; or a Lewis acid complex catalyst such as an aluminum chloride-based system, or a boron fluoride-based system.

The number average molecular weight (Mn) of the olefin polymer (B) is 1,000 or more and 12,000 or less. Selecting those having such a relatively low number average molecular weight may improve fuel saving performance, fatigue lifetime and shear stability, and may improve sludge formation suppression and detergency. From the same viewpoints, the number average molecular weight of the olefin polymer (B) is preferably 1,100 or more, more preferably 1,200 or more, even more preferably 1,500 or more. The upper limit is preferably 10,000 or less, more preferably 8,000 or less, even more preferably 7,000 or less.

In this description, the number average molecular weight (Mn) is measured, for example, using a GPC apparatus (model number: HLC-8220 Model, manufactured by Tosoh Corporation) equipped with columns of TSKgel GMH-XL (two)+G2000H-XL (one) (all manufactured by Tosoh Corporation), and under the condition of a detector: a reflective index detector, a measurement temperature: 40° C., a mobile phase: tetrahydrofuran, a flow rate: 1.0 ml/min, and a concentration: 1.0 mg/ml, and is determined as a standard polystyrene-equivalent value.

The kinematic viscosity at 100° C. of the olefin polymer (B) is preferably 300 $mm^2/s$ or more, more preferably 400 $mm^2/s$ or more, even more preferably 500 $mm^2/s$ or more. The upper limit is preferably 3,000 $mm^2/s$ or less, more preferably 2,500 $mm^2/s$ or less, even more preferably 2,300 $mm^2/s$ or less. The olefin polymer (B) whose kinematic viscosity at 100° C. falls within the above range may improve especially fatigue lifetime and shear stability.

From the same viewpoints, the viscosity index of the olefin polymer (B) is preferably 180 or more, more preferably 200 or more, even more preferably 220 or more. The upper limit is preferably 400 or less, more preferably 350 or less, even more preferably 320 or less.

The content of the olefin polymer (B) based on the total amount of the composition is preferably 1% by mass or more, more preferably 1.5% by mass or mores, even more preferably 2% by mass or more. The upper limit is preferably 15% by mass or less, more preferably 13% by mass or less, even more preferably 10% by mass or less. The olefin polymer whose content falls within the above range may efficiently especially improve fuel saving performance, fatigue lifetime and shear stability.

<Sulfur Compound (C)>

The lubricating oil composition of the present embodiment contains a sulfur compound (C) having a structural unit shown by the following general formula (1) (hereinunder may be simply referred to as "sulfur compound (C)"). In the present embodiment, when the composition does not contain the sulfur compound (C), a good lubricating film could not be formed and in particular, excellent wear resistance and fatigue lifetime could not be obtained.

$$-(R^1-S_m)- \quad (1)$$

In the general formula (1), $R^1$ represents a divalent hydrocarbon group, and the hydrocarbon group is, from the viewpoint of wear resistance and fatigue lifetime, preferably an alkylene group or an alkenylene group, and more preferably an alkylene group. Also from the same viewpoints, the carbon number is preferably 1 or more, more preferably 3 or more, even more preferably 6 or more; and the upper limit is preferably 40 or less, more preferably 36 or less, even more preferably 30 or less.

The alkylene group includes a methylene group, an ethylene group, various propylene groups, various butylene groups, various pentylene groups, various hexylene groups, various heptylene groups, various octylene groups, various nonylene groups, various decylene groups, various undecylene groups, various dodecylene groups, various tridecylene groups, various tetradecylene groups, various pentadecylene groups, various hexadecylene groups, various heptadecylene groups, various octadecylene groups, various nonadecylene groups, various eicosylene groups, various heneicosylene groups, various docosylene groups, various tricosylene groups, various tetracosylene groups, various pentacosylene groups, various hexacosylene groups, various heptacosylene groups, various octacosylene groups, various nonacosylene groups, various triacontylene groups, various hentriacontylene groups, various dotriacontylene groups, various tritriacontylene groups, various tetratriacontylene groups, various pentatriacontylene groups, various hexatriacontylene groups, various heptatriacontylene groups, various octatriacontylene groups, various nonatriacontylene groups, and various tetracontylene groups. The alkenylene group includes those derived from the alkylene group by removing one hydrogen atom.

These hydrocarbon group may be any of linear, branched or cyclic ones.

In the general formula (1), $m_1$ is an integer of 4 or more, and the upper limit is not specifically limited; however, in consideration of wear resistance, fatigue lifetime, availability and corrosion resistance, the number is preferably 10 or less, more preferably 8 or less, even more preferably 5 or less.

More specifically, examples of the sulfur compound (C) include those represented by the following general formula (3).

$$R^3-S_{n1}-(R^1-S_{m1})_p-R^4 \quad (3)$$

In the general formula (3), $R^1$ and $m_1$ are the same as $R^1$ and $m_1$ in the above general formula (1). $R^3$ and $R^4$ each independently represent a monovalent hydrocarbon group, $n_1$ represents an integer of 10 or less and p represents an integer of 1 or more and 4 or less.

The monovalent hydrocarbon group is, from the viewpoint of wear resistance and fatigue lifetime, preferably an alkyl group, an alkenyl group, a cycloalkyl group, an aryl group, or an arylalkyl group, and further inconsideration of availability, an alkyl group or an alkenyl group is preferred, and an alkyl group is more preferred.

As the alkyl group, preferred are those having a carbon number of 1 or more and 24 or less, more preferably 3 or more and 20 or less, even more preferably 6 or more and 16 or less. More specifically, the alkyl group includes a methyl group, an ethyl group, various propyl groups, various butyl groups, various pentyl groups, various hexyl groups, various heptyl groups, various octyl groups, various nonyl groups, various decyl groups, various undecyl groups, various dodecyl groups, various tridecyl groups, various tetradecyl groups, various pentadecyl groups, various hexadecyl groups, various heptadecyl groups, various octadecyl groups, various nonadecyl groups, various eicosyl groups, various heneicosyl groups, various docosyl groups, various tricosyl groups, and various tetracosyl groups. The alkenyl group include those derived from these alkyl groups by removing one hydrogen atom.

Examples of the cycloalkyl group include those preferably having 6 or more and 12 or less carbon atoms, such as a cyclohexyl group, various methylcyclohexyl groups, various ethylcyclohexyl groups, and various dimethylcyclohexyl groups; the aryl group includes those preferably having 6 or more and 12 or less carbon atoms such as a phenyl group, various methylphenyl groups, various ethylphenyl groups, various dimethylphenyl groups, various propylphenyl groups, various trimethylphenyl groups, various butylphenyl groups, and various naphthyl groups; the arylalkyl group includes those preferably having 7 or more and 12 or less carbon atoms such as a benzyl group, a phenethyl group, various phenylpropyl groups, various phenylbutyl groups, various methylbenzyl groups, various ethylbenzyl groups, various propylbenzyl groups, various butylbenzyl groups, and various hexylbenzyl groups.

$n_1$ is an integer of 10 or less, and the upper limit is, in consideration of wear resistance, fatigue lifetime, availability and corrosion resistance, preferably 8 or less, more preferably 7 or less, even more preferably 6 or less. The lower limit is not specifically limited, and may be 0.

p is an integer of 1 or more and 4 or less, and the upper limit is, inconsideration of wear resistance, fatigue lifetime, availability and corrosion resistance, preferably 3 or less, more preferably 2 or less.

The content of the sulfur compound (C) based on the total amount of the composition is preferably 0.01% by mass or more, more preferably 0.05% by mass or more, even more preferably 0.1% by mass or more. The upper limit is preferably 3% by mass or less, more preferably 2% by mass or less, even more preferably 1.5% by mass or less. When the content of the sulfur compound (C) falls within the above range, excellent wear resistance and fatigue lifetime can be effectively attained. In addition, the sulfur atom content in the lubricating oil composition is easy to control.

Also from the same viewpoints, the content of the sulfur atoms derived from the sulfur compound (C) is, based on the total amount of the composition, preferably 0.01% by mass or more, more preferably 0.03% by mass or more, even more preferably 0.05% by mass or more. The upper limit is preferably 1% by mass or less, more preferably 0.8% by mass or less, even more preferably 0.5% by mass or less.

<Thiadiazole Compound (D1), and Sulfur Compound (D2) Having Structural Unit Represented by General Formula (2)>

The lubricating oil composition of the present embodiment preferably further contains at least one sulfur compound (D) selected from a thiadiazole compound (D1) and a sulfur compound (D2) having a structural unit represented by the following general formula (2) (hereinafter may be simply referred to as "sulfur compound (D2)"). Blending the sulfur compound (D) may improve especially seizure resistance and wear resistance.

(Thiadiazole Compound (D1))

Examples of the thiadiazole compound (D1) include thiadiazoles such as 1,4,5-thiadiazole, 1,2,4-thiadiazole, 1,2,5-thiadiazole, and 1,3,4-thiadiazole, and derivatives thereof; and dithiadiazoles such as 1,3,2,4-dithiadiazole, and derivatives thereof. Examples of derivatives thereof include those having a group $—S_k—R^5$ (where $R^5$ represents a hydrogen atom or an alkyl group, and k represents an integer of 0 or more and 2 or less) on at least one carbon atom constituting the thiadiazole ring in the above-mentioned thiadiazole compounds, for example, those preferably having 1 or more and 7 or less, more preferably 2 or more and 6 or less, and even more preferably 3 or more and 5 or less sulfur atoms in the molecule, such as mercapto(alkylthio)thiadiazoles, dimercaptothiadiazoles, bis(alkylthio)thiadiazoles, mercapto(alkyldithio)thiadiazoles, and bis(alkyldithio)thiadiazoles. More specifically, bis(alkyldithio)thiadiazoles such as various bis(hexyldithio)thiadiazoles such as 2,5-bis(hexyldithio)-1,3,4-thiadiazole, 3,5-bis(hexyldithio)-1,2,4-thiadiazole, and 4,5-bis(hexyldithio)-1,2,3-thiadiazole, various bis(octyldithio)thiadiazoles, various bis(nonyldithio)thiadiazoles, and various bis(tetramethylbutyldithio)thiadiazoles are preferred. Using the thiadiazole compound (D1) may improve especially wear resistance.

Regarding the alkyl group represented by $R^5$, the carbon number thereof is, from the viewpoint of improving lubricity, preferably 6 or more and 30 or less as the total in all $R^5$'s groups in one molecule of the thiadiazole, and more preferably the carbon number is 6 or more and 24 or less. Examples of the alkyl group include alkyl groups having 1 or more and 30 or less as exemplified for the monovalent hydrocarbon group for $R^3$ and $R^4$.

The thiadiazole derivatives include those having an amino group or the like on at least one carbon atom constituting the thiadiazole ring in thiadiazole compounds, for example, thiadiazole compounds such as 2-amino-5-mercapto-1,3,4-thiadiazole.

In the present embodiment, one of these thiadiazole compounds (D1) may be used singly or plural kinds thereof may be used in combination.

The content of the thiadiazole compound (D1), based on the total amount of the composition, is preferably 0.1% by mass or more, more preferably 0.5% by mass or more, even more preferably 1% by mass or more. The upper limit is preferably 10% by mass or less, more preferably 8% by mass or less, even more preferably 6% by mass or less. The content of the thiadiazole compound (D1) falling within the above range may effectively improve wear resistance and may reduce smells more effectively. In addition, the content of sulfur atoms in the lubricating oil composition can be more readily controlled.

(Sulfur Compound (D2))

The sulfur compound (D2) has a structural unit represented by the following general formula (2). Using the sulfur compound (D2) may improve especially seizure resistance.

$$-(R^2—S_{m2})- \quad (2)$$

In the general formula (2), $R^2$ represents a divalent hydrocarbon group. Examples of the divalent hydrocarbon group of $R^2$ are the same as those of the divalent hydrocarbon group of $R^1$ in the general formula (1).

$m_2$ represents an integer of 1 or more and 3 or less, preferably 2 or more and 3 or less, and is especially preferably 3. Using the sulfur compound (C) having 4 or more sulfur atoms, and at least one sulfur compound (D) selected from the thiadiazole compound (D1) having a thiadiazole ring and the sulfur compound (D2) having 1 or more and 3 or less sulfur atoms in combination may synergistically effectively improve seizure resistance, wear resistance and fatigue lifetime.

More specifically, examples of the sulfur compound (D2) include those represented by the following general formula (4).

$$R^5—S_{n2}—(R^2—S_{m2})_p—R^6 \quad (4)$$

In the general formula (4), $R^2$ and $m_2$ are the same as $R^2$ and $m_2$ in the general formula (2). $R^5$ and $R^6$ each independently represent a monovalent hydrocarbon group, $n_2$ represents an integer of 10 or less, and q represents an integer of 1 or more and 4 or less.

The carbon number of the divalent hydrocarbon group of $R^2$ is preferably 1 or more, more preferably 2 or more, even more preferably 3 or more, and the upper limit is preferably 24 or less, more preferably 10 or less, even more preferably 8 or less.

Examples of the monovalent hydrocarbon group of $R^5$ and $R^6$ include the same ones as those of $R^3$ and $R^4$ in the general formula (1). The carbon number of the monovalent hydrocarbon group is 1 or more and 24 or less, more preferably 2 or more and 10 or less, even more preferably 3 or more and 8 or less.

$n_2$ is an integer of 10 or less, and the upper limit is, in consideration of wear resistance, fatigue lifetime, availability and corrosion resistance, preferably 8 or less, more preferably 6 or less. The lower limit is not specifically limited, and may be 0.

q is an integer of 1 or more and 4 or less, and the upper limit is, in consideration of wear resistance, fatigue lifetime, availability and corrosion resistance, preferably 3 or less, more preferably 2 or less.

In the present embodiment, one of these sulfur compounds (D2) may be used alone or plural kinds thereof may be used in combination.

The content of the sulfur compound (D2), based on the total amount of the composition, is preferably 0.1% by mass or more, more preferably 0.5% by mass or more, even more preferably 1% by mass or more. The upper limit is preferably 10% by mass or less, more preferably 8% by mass or less, even more preferably 5% by mass or less. The content of the sulfur compound (D2) falling within the above range may effectively improve seizure resistance and may reduce smells more effectively. In addition, the content of sulfur atoms in the lubricating oil composition can be more readily controlled.

<Phosphorus Acid Ester (E)>

Preferably, the lubricating oil composition of the present embodiment further contains a phosphorus acid ester (E). Blending a phosphorus acid ester (E) may improve especially seizure resistance and wear resistance.

Preferred examples of the phosphorus acid ester (E) include phosphate esters such as aryl phosphates, alkyl phosphates, alkenyl phosphates, alkylaryl phosphates and alkoxyalkyl phosphates; acid phosphate esters corresponding to them; phosphite esters such as aryl hydrogenphosphites, alkyl hydrogenphosphites, aryl phosphites, alkyl phosphites, and arylalkyl phosphites; acid phosphite esters corresponding to them, and amine salts thereof.

Among these, from the viewpoint of seizure resistance and wear resistance, aryl phosphates, alkyl phosphates, alkyl acid phosphates, alkoxyalkyl phosphates, alkyl hydrogenphosphites, aryl phosphites, arylalkyl phosphites, and acid alkyl phosphites are preferred; and aryl phosphates, alkoxyalkyl acid phosphates, alkyl hydrogen phosphites, and arylalkyl phosphites are more preferred. More specifically, tricresyl phosphate (TCP), butoxyethyl acid phosphate, tri (nonylphenyl) phosphite, dioleyl hydrogenphosphite, and 2-ethylhexyl diphenyl phosphite are preferred.

In addition, as the phosphorus acid ester (E), those containing a sulfur atom in the molecule, for example, monothiophosphates, dithiophosphates, trithiophosphates, monothiophosphate amine salts, dithiophosphate amine salts, monothiophosphites, dithiophosphites and trithiophosphites are also preferred.

Among these, from the viewpoint of seizure resistance and wear resistance, dithiophosphates such as dialkyl dithiophosphates, diaryl dithiophosphates, for example, dihexyl dithiophosphate, dioctyl dithiophosphate, di(octylthioethyl) dithiophosphate, dicyclohexyl dithiophosphate, dioleyl dithiophosphate, diphenyl dithiophosphate and dibenzyl dithiophosphate are preferred.

In the present embodiment, one of these phosphorus acid esters (E) may be used singly or plural kinds thereof may be used in combination.

The content of the phosphorus acid ester (E), based on the total amount of the composition, is preferably 0.1% by mass or more, more preferably 0.3% by mass or more, even more preferably, 0.5% by mass or more. The upper limit is preferably 10% by mass or less, more preferably 5% by mass or less, even more preferably 3% by mass or less. The content of the phosphorus acid ester (E) falling within the above range may effectively improve seizure resistance and wear resistance. The phosphorus acid ester (E) containing a sulfur atom may reduce smells more effectively and can readily control the content of sulfur atoms in the lubricating oil composition.

<Other Additives>

In addition to the base oil (A), the olefin polymer (B), the sulfur compound (C), and the sulfur compound (D) and the phosphorus acid ester (E) preferably used, any other additives, for example, other additives such as a viscosity index improver, a pour point depressant, a friction modifier, a dispersant, an antioxidant and an anti-foaming agent may appropriately selected and blended in the lubricating oil composition of the present embodiment within a range not interfering with the object of the present invention. One of these additives may be used singly or plural kinds thereof may be used in combination. The lubricating oil composition of the present embodiment may be composed of the base oil (A), the olefin polymer (B) and the sulfur compound (C), or may be composed of the base oil (A), the olefin polymer (B), the sulfur compound (C) and the sulfur compound (D), or may be composed of the base oil (A), the olefin polymer (B), the sulfur compound (C), the sulfur compound (D) and the phosphorus acid ester (E), or may be composed of these and further other additives. The sulfur compound (D) contains at least one of the thiadiazole compound (D1) and the sulfur compound (D2).

Falling within a range not conflicting with the object of the present invention, the total content of the other additives is not specifically limited but is, in consideration of the effect of the other additives to be added, preferably 0.1% by mass or more based on the total amount of the composition, more preferably 0.5% by mass or more, even more preferably 1% by mass or more. The upper limit is preferably 15% by mass or less, more preferably 13% by mass or less, even more preferably 10% by mass or less.

(Viscosity Index Improver)

Examples of the viscosity index improver include polymers such as non-dispersant-type polymethacrylates, dispersant-type polymethacrylates, and styrene-based copolymers (for example, styrene-diene copolymers, and styrene-isoprene copolymers).

The number average molecular weight (Mn) of the viscosity index improver may be suitably settled depending on the kind thereof but is, from the viewpoint of viscosity characteristics, preferably 500 or more and 1,000,000 or less, more preferably 5,000 or more and 800,000 or less, even more preferably 10,000 or more and 600,000 or less.

Preferably, the number average molecular weight of non-dispersant-type and dispersant-type polymethacrylates is 5,000 or more and 300,000 or less, more preferably 10,000 or more and 150,000 or less, even more preferably 20,000 or more and 100,000 or less.

The content of the viscosity index improver is, from the viewpoint of viscosity characteristics, preferably 0.5% by mass or more based on the total amount of the composition, more preferably 1% by mass or more, even more preferably 3% by mass or more. The upper limit is preferably 10% by mass or less, more preferably 9% by mass or less, even more preferably 8% by mass or less.

(Pour Point Depressant)

Examples of the pour point depressant include ethylene-vinyl acetate copolymers, condensates of chloroparaffin and naphthalene, condensates of chloroparaffin and phenol, polymethacrylates, and polyalkylstyrenes.

(Friction Modifier)

Examples of the friction modifier include ash-free friction modifiers such as aliphatic amines, aliphatic alcohols, fatty acid amines, fatty acid esters, fatty acid amides, fatty acids and fatty acid ethers having at least one alkyl or alkenyl group having 6 or more and 30 or less carbon atoms, especially a linear alkyl or alkenyl group having 6 or more and 30 or less carbon atoms in the molecule; and molybdenum-based friction modifiers such as molybdenum dithiocarbamate (MoDTC), molybdenum dithiophosphate (MoDTP), and molybdic acid amine salts.

In the case where an ash-free friction modifier is used, the content thereof based on the total amount of the composition is preferably 0.01% by mass or more, more preferably 0.05% by mass or more, even more preferably 0.1% by mass or more. The upper limit is preferably 3% by mass or less, more preferably 2% by mass or less, even more preferably 1.5% by mass or less. In the case where a molybdenum-based friction modifier is used, the content thereof based on the total amount of the composition is, as a molybdenum atom-equivalent content, preferably 60 ppm by mass or more, more preferably 70 ppm by mass or more, even more preferably 80 ppm by mass or more. The upper limit is preferably 1,000 ppm by mass or less, more preferably 900 ppm by mass or less, even more preferably 800 ppm by mass or less. The content falling within the range may attain excellent fuel saving performance and wear resistance and can prevent reduction in detergency.

(Dispersant)

Examples of the dispersant include ash-free dispersants such as boron-free succinimides, boron-containing succinimides, benzylamines, boron-containing benzylamines, succinates, and mono or dicarboxylic acid amides of typically fatty acids or succinic acid.

(Antioxidant)

Examples of the antioxidant include amine-based antioxidants such as diphenylamine-based antioxidants and naphthylamine-based antioxidants; phenol-based antioxidants such as monophenol-based antioxidants, diphenol-based antioxidants, and hindered phenol-based antioxidants; molybdenum-based antioxidants produced through reaction of molybdenum trioxide and/or molybdic acid and an amine compound; sulfur-based antioxidants such as phenothiazine, dioctadecyl sulfide, dilauryl-3,3'-thiodipropionate, and 2-mercaptobenzimidazole; and phosphorus-based antioxidants such as triphenyl phosphite, diisopropylmonophenyl phosphite, and monobutyldiphenyl phosphite.

(Anti-Foaming Agent)

Examples of the anti-foaming agent include silicone oils, fluorosilicone oils, and fluoroalkyl ethers.

(Various Properties of Lubricating Oil Composition)

In the lubricating oil composition of the present embodiment, the content of all sulfur atoms contained in the composition, based on the total amount of the composition is required to be 1.2% by mass or more and 2.5% by mass or less. When the content of all sulfur atoms is less than 1.2% by mass, excellent seizure resistance and excellent wear resistance could not be attained, but on the other hand, when the content is more than 2.5% by mass, excellent wear resistance and fatigue lifetime could not be attained. Here, the total sulfur atoms at least contain the sulfur atoms contained in the sulfur compound (C), and may further contain the sulfur atoms contained in the sulfur compound (D) that may be optionally used as well as the sulfur atoms in the phosphorus acid ester (E) containing sulfur atoms that may be also optionally used. In the case where a mineral oil is used as the base oil (A), it may contain a sulfur atom, and therefore the composition may also contain the sulfur atom derived from the base oil (A), but the content thereof is generally 0.1% by mass or less as compared with that of the sulfur atoms derived from the other components, and is therefore negligible. From the viewpoint of improving wear resistance, seizure resistance, fatigue lifetime and fuel saving performance, the content is preferably 1.3% by mass or more, more preferably 1.4% by mass or more, even more preferably 1.5% by mass or more. From the viewpoint of oxidation stability, the upper limit is preferably 2.45% by mass or less, more preferably 2.4% by mass or less, even more preferably 2.35% by mass or less.

In the lubricating oil composition of the present embodiment, the content of the sulfur atoms in the sulfur compound (C) relative to all the sulfur atoms in the composition is preferably 1% by mass or more, more preferably 1.5% by mass or more, even more preferably 2% by mass or more. The upper limit is preferably 20% by mass or less, more preferably 19% by mass or less, even more preferably 18% by mass or less. When the content of the sulfur atoms in the sulfur compound (C) relative to all the sulfur atoms falls within the above range, wear resistance and fatigue lifetime can be especially improved.

In the lubricating oil composition of the present embodiment, the ratio by mass of sulfur atoms to phosphorus atoms in the composition (S/P ratio) is preferably 8 or more, more preferably 9 or more, even more preferably 10 or more. The upper limit is preferably 16 or less, more preferably 15.5 or less, even more preferably 15 or less. When the ratio by mass of sulfur atoms to phosphorus atoms (S/P ratio) falls within the above range, seizure resistance, wear resistance and fatigue lifetime can be especially improved.

The kinematic viscosity at 100° C. of the lubricating oil composition of the present embodiment is preferably 6 $mm^2/s$ or more, more preferably 6.5 $mm^2/s$ or more, even more preferably 7 $mm^2/s$ or more. The upper limit is preferably 11 $mm^2/s$ or less, more preferably 10.5 $mm^2/s$ or less, even more preferably 10 $mm^2/s$ or less. The kinematic viscosity at 40° C. of the lubricating oil composition of the present embodiment is preferably 10 $mm^2/s$ or more, more preferably 20 $mm^2/s$ or more, even more preferably 25 $mm^2/s$ or more. The upper limit is preferably 60 $mm^2/s$ or less, more preferably 55 $mm^2/s$ or less, even more preferably 50 $mm^2/s$ or less. The lubricating oil composition whose kinematic viscosity falls within the above range betters fuel saving performance, improves seizure resistance and shear stability, and can form a sufficient oil film on a slide surface to reduce equipment wear owing to oil film shortage and improve fatigue lifetime.

From the same viewpoints, the viscosity index of the lubricating oil composition is preferably 120 or more, more preferably 140 or more, even more preferably 150 or more.

The reduction (%) of the kinematic viscosity at 100° C., as measured in a KRL shear stability test according to ISO 26422(2014), of the lubricating oil composition of the present embodiment is preferably 8% or less, more preferably 7% or less, even more preferably 6% or less.

As described above, the lubricating oil composition of the present embodiment is excellent in fuel saving performance, seizure resistance, wear resistance, fatigue lifetime and shear stability. Taking advantage of such characteristics, the lubricating oil composition of the present embodiment is used, for example, as an internal combustion engine oil for use in gasoline engines, diesel engines and other internal combustion engines, a gear oil for vehicles such as gasoline vehicles, hybrid vehicles, and electric vehicles, and a gear oil for industrial use for other general machinery, and is, above all, favorably used for lubrication of automotive differential gears. In addition, the lubricating oil composition is also favorably used for other uses, for example, for internal combustion engines, hydraulic machinery, turbines, compressors, working machines, cutting machines, gears, and machines equipped with liquid bearings or ball bearings.

[Lubrication Method]

The lubrication method of the present embodiment is a lubrication method using the lubricating oil composition of the present embodiment described above. The lubricating oil composition for use in the lubrication method of the present embodiment is excellent in fuel saving performance, seizure resistance, wear resistance, fatigue lifetime and shear stability. Accordingly, the lubrication method of the present embodiment is favorably used for lubrication of internal combustion engines, lubrication of gears for vehicles such as gasoline vehicles, hybrid vehicles and electric vehicles, and lubrication of industrial gears such as other general machinery, and above all, for lubrication of automotive differential gears. In addition, the lubrication method is also favorably used for other uses, for example, for internal combustion engines, hydraulic machinery, turbines, compressors, working machines, cutting machines, gears, and machines equipped with liquid bearings or ball bearings.

EXAMPLES

Next, the present invention is described in more detail with reference to Examples, but the present invention is not limited at all by these Examples.

Examples 1 to 5, Comparative Examples 1 to 5

Lubricating oil compositions were prepared at the blending ratio (% by mass) shown in Table 1. The resultant lubricating oil compositions were tested variously according to the methods mentioned below to evaluate the properties thereof. The evaluation results are shown in Table 1 and Table 2.

The properties of the lubricating oil compositions were measured and evaluated according to the following methods.

(1) Kinematic Viscosity

The kinematic viscosity at 40° C. and 100° C. was measured according to JIS K 2283:2000.

(2) Viscosity Index (VI)

Measured according to JIS K 2283:2000.

(3) Content of Sulfur Atoms and Phosphorus Atoms

Measured according to JIS-5S-38-92.

(4) Evaluation of Shear Stability

The reduction (%) of the kinematic viscosity at 100° C., measured in the KRL shear stability test according to ISO 26422(2014) was referred to as an index of shear stability. A smaller value of reduction indicates more excellent shear stability.

(5) Evaluation of Seizure Resistance (Shell Four-Ball Load Resistance (EP) Test)

According to ASTM D2783-03 (2014), each sample was tested at a rotation number of 1800 rpm and under the condition of room temperature to measure the weld load WL (N), and evaluated according to the following criteria. A larger value of the data indicates more excellent seizure resistance.

A: The weld load WL was 3,000 N or more.

B: The weld load WL was 2,500 N or more and less than 3000 N.

C: The weld load WL was less than 2,500 N.

(6) Evaluation of Wear Resistance (Shell Four-Ball Wear (WEAR) Test)

According to ASTM D4172-94 (2010), each sample was tested under the condition of 100° C., 1800 rpm, and 192 N or 392 N for 60 minutes to measure the wear track diameter (mm), and evaluated according to the following criteria. A smaller value of the data indicates more excellent wear resistance.

A: The wear track diameter was 0.35 mm or less.

B: The wear track diameter was more than 0.35 mm and less than 0.6 mm.

C: The wear track diameter was 0.7 mm or more.

(7) Evaluation of Fatigue Lifetime

Using a two-cylinder fatigue tester in the manner mentioned below, a test of measuring the motor rotation number until occurrence of surface peeling on a test piece was carried out three times, and the mean value of the data of the cumulative motor rotation number was calculated to evaluate the test piece according to the following criteria. A larger mean value indicates more excellent fatigue lifetime.

A: The cumulative motor rotation number was $10^7$ or more.

B: The cumulative motor rotation number was $5\times10^6$ or more and less than $10^7$.

C: The cumulative motor rotation number was less than $5\times10^6$.

(Two Cylinders)

Material: SCM420H (gas carburization)

Test piece size

Small cylinder: ϕ20 mm (surface flat)

Large cylinder: ϕ88 mm (R300 crowning)

(Test Condition)

Face pressure: 3 GPa

Small roller rotation speed: 2,000 rpm

Slip percentage: −38.5%

Oil temperature: 90° C.

Oil supply: 2.0 L/min

TABLE 1

| | | Example | | | | | Comparative Example | | | | |
|---|---|---|---|---|---|---|---|---|---|---|---|
| | | 1 | 2 | 3 | 4 | 5 | 1 | 2 | 3 | 4 | 5 |
| (A) | Base Oil: mineral oil 1, % by mass | 78.9 | 74.9 | 75.9 | 74.1 | 78.4 | 77.6 | 79.1 | 78.9 | 78.6 | 80.9 |
| | Base Oil: PAO, % by mass | — | 9.0 | 9.0 | 9.0 | — | — | — | — | — | — |
| | Base Oil: ester base oil, % by mass | 5.0 | 5.0 | 5.0 | 5.0 | 5.0 | 5.0 | 5.0 | 5.0 | 5.0 | 5.0 |
| (B) | Olefin Polymer, % by mass | 8.0 | 3.0 | 3.0 | 3.0 | 3.0 | 8.0 | 8.0 | — | 8.0 | 8.0 |
| | PMA, % by mass | — | — | — | — | 5.0 | — | — | 8.0 | — | — |
| (C) | Sulfur Compound 1, % by mass | 0.2 | 0.2 | 0.2 | 1.0 | 0.2 | 1.5 | — | 0.2 | — | 0.2 |
| (D) | (D1) Thiadiazole Compound, % by mass | 4.5 | 4.5 | 3.5 | 4.5 | 1.5 | 4.5 | 4.5 | 4.5 | 1.5 | 2.5 |
| | (D2) Sulfur Compound 2, % by mass | — | — | — | — | 3.5 | — | — | — | 3.5 | — |

TABLE 1-continued

| | Example | | | | | Comparative Example | | | | |
|---|---|---|---|---|---|---|---|---|---|---|
| | 1 | 2 | 3 | 4 | 5 | 1 | 2 | 3 | 4 | 5 |
| (E) Phosphorus Acid Ester, % by mass | 1.2 | 1.2 | 1.2 | 1.2 | 1.2 | 1.2 | 1.2 | 1.2 | 1.2 | 1.2 |
| Other Additives, % by mass | 2.2 | 2.2 | 2.2 | 2.2 | 2.2 | 2.2 | 2.2 | 2.2 | 2.2 | 2.2 |
| Total, % by mass | 100.0 | 100.0 | 100.0 | 100.0 | 100.0 | 100.0 | 100.0 | 100.0 | 100.0 | 100.0 |
| (A) Properties of Base Oil | | | | | | | | | | |
| Kinematic viscosity at 40° C., $mm^2/s$ | 20.9 | 30.1 | 30.1 | 30.1 | 20.9 | 20.9 | 20.9 | 20.9 | 20.9 | 20.9 |
| Kinematic viscosity at 100° C., $mm^2/s$ | 4.42 | 6.17 | 6.17 | 6.18 | 4.42 | 4.42 | 4.42 | 4.42 | 4.42 | 4.42 |
| Viscosity Index | 123 | 160 | 160 | 160 | 123 | 123 | 123 | 123 | 123 | 123 |
| Properties of Lubricating Oil Composition | | | | | | | | | | |
| Kinematic viscosity at 40° C., $mm^2/s$ | 38.5 | 45.0 | 44.8 | 45.0 | 44.5 | 38.4 | 38.5 | 47.2 | 38.4 | 38.5 |
| Kinematic viscosity at 100° C., $mm^2/s$ | 7.72 | 8.64 | 8.55 | 8.65 | 9.55 | 7.73 | 7.70 | 10.3 | 7.72 | 7.72 |
| Viscosity Index | 175 | 174 | 172 | 174 | 207 | 176 | 174 | 215 | 176 | 175 |
| Content of all sulfur atoms*1, % by mass | 2.02 | 2.02 | 1.59 | 2.33 | 2.13 | 2.53 | 1.94 | 2.02 | 2.05 | 1.16 |
| Content of sulfur atoms (C)*2, % by mass | 0.08 | 0.08 | 0.08 | 0.39 | 0.08 | 0.59 | 0.0 | 0.08 | 0.0 | 0.08 |
| Sulfur atoms (C)/All sulfur atoms*3, % by mass | 4.0 | 4.0 | 5.0 | 16.7 | 3.8 | 23.3 | 0.0 | 4.0 | 0.0 | 6.9 |
| Content of phosphorus atoms*4, % by mass | 0.15 | 0.15 | 0.15 | 0.15 | 0.15 | 0.15 | 0.15 | 0.15 | 0.15 | 0.15 |
| Ratio by mass of sulfur atoms/phosphorus atoms*5(S/P ratio) | 13.5 | 13.5 | 10.6 | 15.5 | 14.2 | 16.9 | 12.9 | 13.5 | 13.7 | 7.7 |
| Shear Stability (%) | 4 | 2 | 2 | 2 | 6 | 4 | 4 | 10 | 4 | 4 |
| Shell 4-ball test: EP (WL), N | 3089 | 3089 | 3089 | 3923 | 3923 | 3923 | 3089 | 3089 | 3089 | 2452 |
| Evaluation | A | A | A | A | A | A | A | A | A | C |
| Shell 4-ball test: WEAR 1 (192 N), mm | 0.31 | 0.30 | 0.32 | 0.33 | 0.35 | 0.70 | 0.31 | 0.31 | 0.78 | 0.36 |
| Evaluation | A | A | A | A | A | C | A | A | C | B |
| Shell 4-ball test: WEAR 2 (392 N), mm | 0.35 | 0.35 | 0.38 | 0.40 | 0.40 | 0.72 | 0.38 | 0.36 | 0.36 | 0.42 |
| Evaluation | A | A | B | B | B | C | B | B | B | B |
| Fatigue Life, cumulative rotation number | $10^7$ or more | $10^7$ or more | $10^7$ or more | $10^7$ or more | $10^7$ or more | $4 \times 10^6$ | $5 \times 10^6$ | $8 \times 10^6$ | $2 \times 10^6$ | $10^7$ or more |
| Evaluation | A | A | A | A | A | C | B | B | C | A |

Note)
*1 to 5 in Table 1 are as follows.
*1Content of all sulfur atoms based on the total amount of the composition.
*2Content of sulfur atoms in the sulfur compound (C) based on the total amount of the composition.
*3Content of sulfur atoms in the sulfur compound (C) relative to all sulfur atoms.
*4Content of phosphor atoms based on the total amount of the composition.
*5Ratio by mass of all sulfur atoms to all phosphorus atoms (S/P ratio) based on the total amount of the composition.

Details of each component shown in Table 1 used in these Examples are as follows.

(A) base oil, mineral oil 1: paraffin-based mineral oil grouped in Group III in the API base oil category, kinematic viscosity at 40° C.: 21 $mm^2/s$, 100° C. kinematic viscosity: 4.5 $mm^2/s$, viscosity index: 116.

(A) base oil, PAO: (A) base oil, poly-α-olefin (PAO), kinematic viscosity at 100° C.: 150 $mm^2/s$, viscosity index: 206.

(A) base oil, ester base oil: (A) base oil, kinematic viscosity at 40° C.: 20 $mm^2/s$, kinematic viscosity at 100° C.: 4.3 $mm^2/s$, viscosity index: 139.

(B) olefin polymer, copolymer of ethylene and propylene (OCP), number average molecular weight (Mn): 3,700, kinematic viscosity at 100° C.: 2,000 $mm^2/s$, viscosity index: 300.

PMA: polymethacrylate, number average molecular weight: 50,000.

(C) sulfur compound 1: compound of general formula (3) where $m_1$ is 4, $n_1$ is 4, p is 1, $R^1$ is an alkylene group having 8 carbon atoms, and $R^3$ and $R^4$ each are an alkyl group having 8 carbon atoms.

(D1) thiadiazole compound, 2,5-bis((1,1,3,3-tetramethylbutyl)dithio)-1,3,4-thiadiazole (D2) sulfur compound 2, compound of general formula (4) where $m_2$ is 3, $n_2$ is 0, q is 1, $R^2$ is an alkylene group having 4 carbon atoms, and $R^5$ and $R^6$ each are an alkyl group having 4 carbon atoms.

(E) phosphorus acid ester, butoxyethyl acid phosphate.

Other additives: pour point depressant (ethylene-vinyl acetate copolymer), dispersant (boron-containing polybutenylsuccinic bisimide), friction modifier (fatty acid ester), antioxidant (phenol-based antioxidant), anti-foaming agent (silicone-based anti-foaming agent).

The results in Table 1 confirm that the lubricating oil compositions of Examples 1 to 5 are excellent in fuel saving performance, seizure resistance, wear resistance, fatigue lifetime, and shear stability.

On the other hand, it is confirmed that the lubricating oil composition of Comparative Example 1 in which the content of all sulfur atoms is more than 2.5% by mass is poor in wear resistance and fatigue lifetime, and the lubricating oil composition of Comparative Example 5 in which the content of all sulfur atoms is less than 1.2% by mass is poor in seizure resistance and wear resistance. Accordingly, it is extremely important for attaining the advantageous effects of the present embodiment to limit the content of all sulfur atoms in the lubricating oil composition to 1.2% by mass or more and 2.5% by mass or less. The lubricating oil composition of Comparative Example 2 not containing at all the sulfur compound (C) was poor in performance of fatigue lifetime, and the lubricating oil composition of Comparative Example 4 differing from that of Comparative Example 2 in point of the formulation of the sulfur compound (D) had a short fatigue lifetime and had poor wear resistance. The lubricating oil composition of Comparative Example 3 did not contain an olefin polymer (B) but contained PMA having the same viscosity index improving performance as that of the olefin polymer; however, the shear stability thereof was extremely low and the fatigue lifetime thereof was not satisfactory.

As described above, it has been confirmed that only the constitution of the present embodiment, namely, only the constitution containing a base oil (A), a specific olefin polymer (B) and a specific sulfur compound (C), and having a content of all sulfur atoms based on the total amount of the composition of 1.2% by mass or more and 2.5% by mass or less can attain fuel saving performance, seizure resistance, wear resistance, fatigue lifetime and shear stability.

INDUSTRIAL APPLICABILITY

The lubricating oil composition of the present embodiment is excellent in fuel saving performance, seizure resistance, wear resistance, fatigue lifetime and shear stability. Accordingly, the lubricating oil composition of the present embodiment can be favorably used, for example, as an internal combustion engine oil for use for gasoline engines, diesel engines and other internal combustion engines, as a gear oil for vehicles such as gasoline vehicles, hybrid vehicles and electric vehicles, and as an industrial-use gear oil for other general machinery, and is, above all, favorably used for lubrication of automotive differential gears.

The invention claimed is:

1. A lubricating oil composition, comprising:

a base oil (A) comprising a mineral and a synthetic oil, wherein the synthetic oil comprises at least one ester oil and optionally at least one poly-α-olefin;

an olefin polymer (B), which is an ethylene-propylene copolymer having a number average molecular weight of 1,500 or more and 7,000 or less;

a sulfur compound (C) represented by formula (3):

$$-(R^1-S_{m1})- \quad (1)$$

$$R^3-S_{n1}-(R^1-S_{m1})_p-R^4 \quad (3)$$

wherein $R^1$ represents a divalent hydrocarbon group, $m_1$ represents an integer of 4, $n_1$ represents an integer of 10 or less, p represents an integer of 1 or more and 4 or less, and $R^3$ and $R^4$ each represent a monovalent hydrocarbon group;

at least one thiadiazole compound (D1); and optionally, polymethacrylate, wherein:

the content of the base oil (A) based on the total amount of the composition is at least 80% by mass, the content of the synthetic oil relative to the base oil (A) ranges from 5.96% by mass to 20% by mass, with the balance of the base oil (A) being the mineral oil, the content of the at least one poly-α-olefin based on the total amount of the composition is 9% by mass or less, the content of the olefin polymer (B) based on the total amount of the composition ranges from 3% by mass or to 8% by mass, the content of the sulfur compound (C) based on the total amount of the composition ranges from 0.2% by mass to 1.5% by mass, the content of the thiadiazole compound (D1) based on the total amount of the composition ranges from 1.5% by mass to 4.5% by mass, the content of polymethacrylate based on the total amount of the composition is 5% by mass or less, and the content of all sulfur atoms based on the total amount of the composition ranges from 1.59% by mass to 2.5% by mass.

2. The lubricating oil composition according to claim 1, wherein the content of sulfur atoms in the sulfur compound (C) relative to all sulfur atoms is 1% by mass or more and 20% by mass or less.

3. The lubricating oil composition according to claim 1, further comprising a sulfur compound (D2) having a structural unit represented by the following general formula (2):

$$-(R^2-S_{m2})- \quad (2)$$

wherein $R^2$ represents a divalent hydrocarbon group, and $m_2$ represents an integer of 1 or more and 3 or less.

4. The lubricating oil composition according to claim 1, further comprising a phosphorus acid ester (E).

5. The lubricating oil composition according to claim 4, wherein the ratio by mass of sulfur atoms to phosphorus atoms (S/P ratio) is 8 or more and 16 or less.

6. The lubricating oil composition according to claim 1, having a kinematic viscosity at 100° C. of 6 $mm^2/s$ or more and 11 $mm^2/s$ or less.

7. The lubricating oil composition according to claim 1, which is for a gear oil.

8. A lubrication method, comprising lubricating a device with the lubricating oil composition of claim 1.

* * * * *